US007676888B2

(12) United States Patent
Vanini

(10) Patent No.: US 7,676,888 B2
(45) Date of Patent: Mar. 16, 2010

(54) HINGE FOR WINGS OR DOORS

(75) Inventor: Angelo Vanini, Bologna (IT)

(73) Assignee: Nuova Star S.p.A., Zola Predosa (Bologna) (IT)

( * ) Notice: Subject to any disclaimer, the term of this patent is extended or adjusted under 35 U.S.C. 154(b) by 234 days.

(21) Appl. No.: 11/783,330

(22) Filed: Apr. 9, 2007

(65) Prior Publication Data

US 2007/0283532 A1 Dec. 13, 2007

(30) Foreign Application Priority Data

Apr. 21, 2006 (IT) ..... BO2006A0308

(51) Int. Cl.
*E05F 1/08* (2006.01)

(52) U.S. Cl. ..... 16/286; 16/277; 16/379

(58) Field of Classification Search ..... 16/277, 16/286, 295, 289, 290, 379, 382; 126/194
See application file for complete search history.

(56) References Cited

U.S. PATENT DOCUMENTS 2,833,270 A * 5/1958 Brown et al. ..... 126/191
2,976,766 A * 3/1961 Bianchi ..... 351/113
3,144,863 A * 8/1964 Pollock ..... 126/191
3,450,125 A * 6/1969 Hopkins ..... 126/191
3,677,259 A * 7/1972 Doner ..... 126/194
3,712,287 A * 1/1973 Summers, Jr. ..... 126/191
3,749,080 A * 7/1973 Kleinhenn ..... 126/191
4,021,968 A * 5/1977 Kendall ..... 49/386
4,658,473 A * 4/1987 Schema ..... 16/290
5,025,776 A * 6/1991 Hanley et al. ..... 126/194
5,822,925 A * 10/1998 McKinney et al. ..... 49/386
6,397,836 B1 6/2002 Pelletier et al.
6,892,423 B2 * 5/2005 Cheal et al. ..... 16/289
6,986,187 B2 * 1/2006 Cummins et al. ..... 16/286
7,017,232 B1 * 3/2006 Priddy ..... 16/286
2003/0213098 A1 * 11/2003 Cummins et al. ..... 16/286
2003/0217436 A1 * 11/2003 Hashim et al. ..... 16/286

* cited by examiner

*Primary Examiner*—Victor Batson
*Assistant Examiner*—Roberta Delisle
(74) *Attorney, Agent, or Firm*—The Nath Law Group; Jerald L. Meyer; Stanley N. Protigal

(57) ABSTRACT

A hinge for wings or doors, in particular of electrical appliances, having a first element, a second element and a rocker lever for connecting the first and second elements; the lever pivots on the second element and has a first arm integral with the first element to render the first and second elements movable relative to one another with a tilting action between a closed position and an open position; the second element consisting of a substantially box-shaped body containing both elastic parts, inserted between the second element and a second arm of the lever to apply an elastic action on the lever, and a damping device, for applying a damping action on the lever during the reciprocal motion of the first and second elements, when the closed position is almost reached.

6 Claims, 7 Drawing Sheets

HINGE FOR WINGS OR DOORS

BACKGROUND OF THE INVENTION

The present invention relates to a hinge for wings or doors.

The use of a hinge made in accordance with the present invention is particularly advantageous for constraining the door of an electrical appliance to the respective supporting frame.

In the following description and by way of example only, without limiting the scope of the invention, the present invention is described with reference to an oven.

In known types of ovens hinges usually comprise two separate elements, kinematically connected to one another and both having a box-shaped structure. More precisely, one of the two box-shaped structures is fixed to the oven supporting frame, at one side of the oven mouth, whilst the other is fixed to one edge of the door, which is that way is rendered movable with a tilting action relative to the above-mentioned frame.

Between the two box-shaped structures a lever, usually a rocker lever, is operatively inserted, pivoting on one of the two box-shaped structures, usually on the one fixed to the door, and having a first arm rigidly constrained to the other of the two box-shaped structures. The second arm of the lever, coplanar with the first, is operated on by elastic elements which influence the movement of the door, for both opening and closing. Said elastic elements are housed in the box-shaped structure to which the lever is hinged and, more precisely, operate between that box-shaped structure and a rod positioned inside it. The free end of the rod, that is to say the end not interacting with the elastic elements, pivots at the above-mentioned second arm of the lever.

During door rotation starting from the closed position, the elastic elements oppose, during a first step, the detachment of the door from the oven supporting frame and, in a second step, subsequent rotation of the door and its consequent lowering to an end of stroke position in which the oven mouth is completely open. In this second opening step, the door, under the combined action of its own weight which promotes its descent and of the elastic elements which apply a braking action, performs a gradual rotation.

During door rotation starting from its open end of stroke position, the action of the elastic elements is first balanced by the weight of the door, initially guaranteeing gradual closing rotation; however, then, in the absence of a braking action by the user, the elastic elements push the door towards the oven frame with such a force that it often closes in a rather sudden and noisy way.

SUMMARY OF THE INVENTION

The present invention has for an aim to provide a hinge for wings or doors which is free of the above-mentioned disadvantage.

Accordingly, the present invention provides a hinge for wings or doors comprising the features described in any of the claims herein.

BRIEF DESCRIPTION OF THE DRAWINGS

The present invention is now described, by way of example and without limiting the scope of application, with reference to the accompanying drawings, in which.

DESCRIPTION OF THE PREFERRED EMBODIMENTS

Figure 1A:
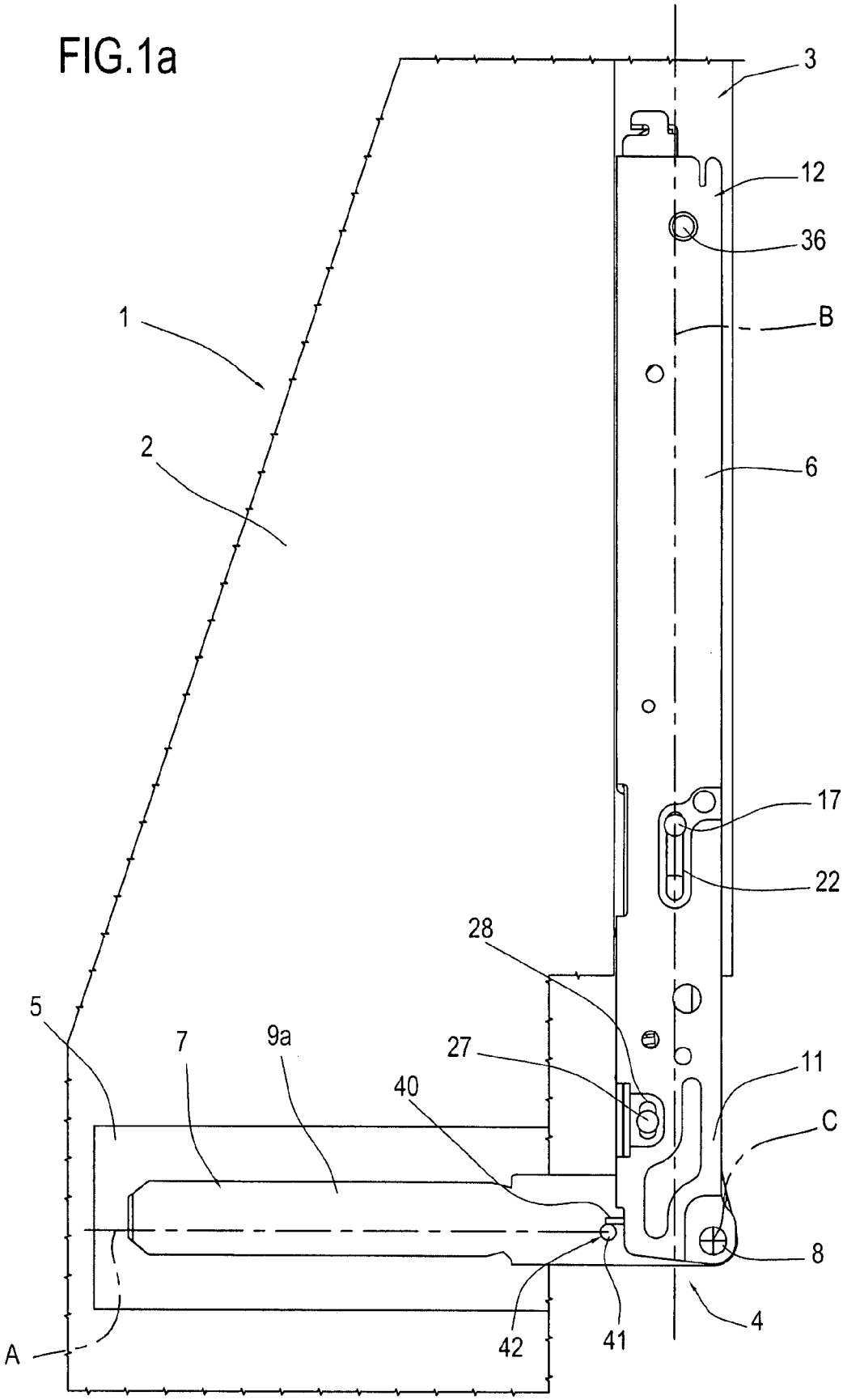
FIGS. 1*a* and 1*b* are respectively a front view and longitudinal section of a hinge made in accordance with the present invention, in its closed position and associated with an oven, the latter only partly, schematically illustrated.
Figure 1B:
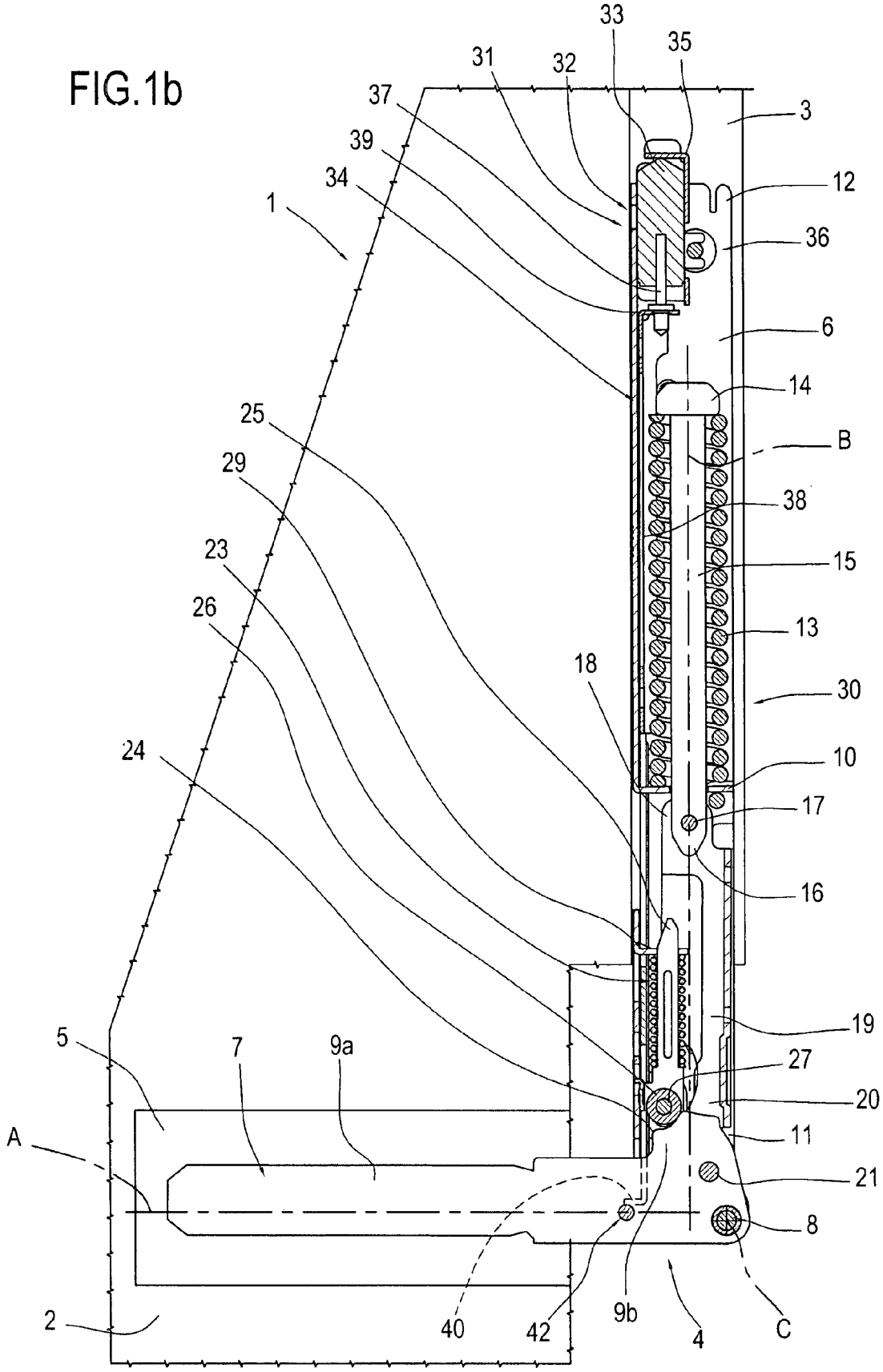

With reference to FIGS. 1*a* and 1*b*, the numeral 1 denotes as a whole an oven comprising a frame 2 to which a door 3 is connected by two hinges 4, only one of which is illustrated.

Each of the two hinges 4 comprises a first element 5, fixed to the oven 1 frame 2 at a respective side of the oven mouth, and a second element 6, fixed to a respective edge of the door 3. In particular, the shape of the first element 5 and the second element 6 is substantially box-shaped and extended and they are kinematically connected to one another by a connecting lever 7 which is also part of the hinge 4. The lever 7 is a rocker lever, pivoting on the second element 6 by means of a pin 8 and has a first arm 9*a* rigidly constrained to the first element 5 to render the door 3 movable with a tilting action relative to the frame 2 between a closed position and an open position.

Figure 4A:
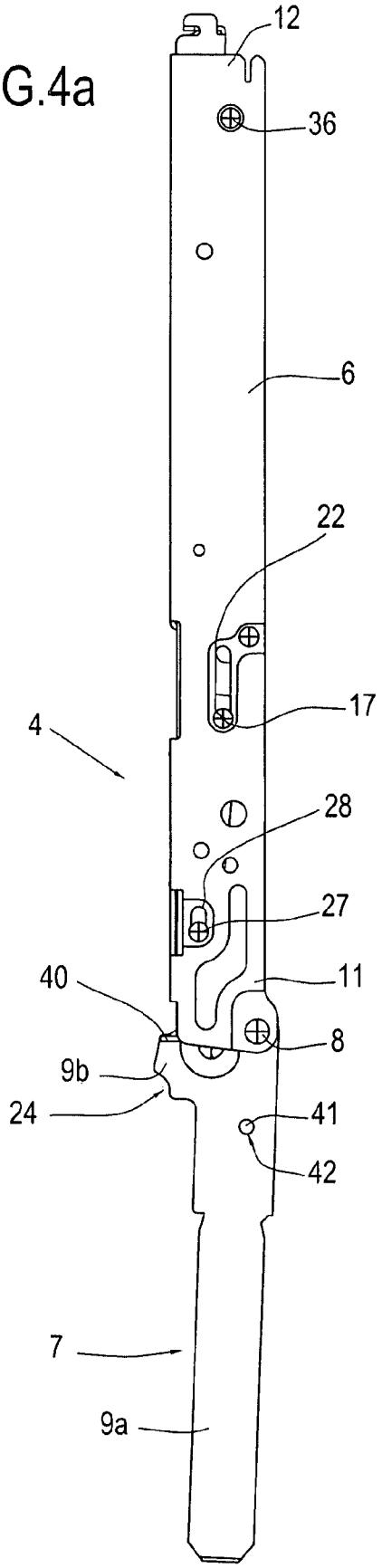
FIGS. 4*a* and 4*b* are respectively a front view and a longitudinal section of the hinge of FIG. 1*a* in its open position.
Figure 4B:
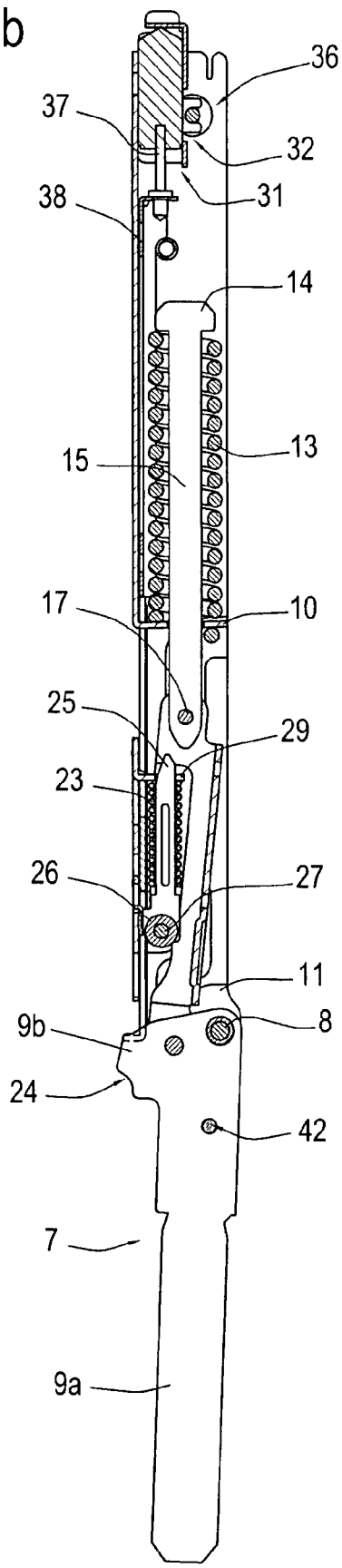

The central longitudinal axes of the lever 7 and of the second element 6, labeled A and B respectively, lie in a plane at a right angle to the central longitudinal axis of the pin 8, labeled C, which is the axis of rotation of the door 3 relative to the frame 2, and they are at a right angle to one another in the above-mentioned closed position (FIGS. 1*a* and 1*b*) and substantially aligned in the above-mentioned open position (FIGS. 4*a* and 4*b*).

As illustrated in FIG. 1*b*, the second element 6 has a transversal separator 10, in an intermediate position between the two longitudinal ends of the second element 6, specifically between the end hinged to the lever 7, labeled 11, and an end opposite to the latter, labeled 12.

Between the separator 10 and the end 12 there is a pre-compressed helical spring 13, held in contact with the separator 10 by the head 14 of a rod 15 positioned coaxially inside the spring 13.

The rod 15 exits the spring 13 longitudinally with one end 16, which passes through an opening made in the separator 10 and points towards the above-mentioned end 11. In this way, the opening made in the separator 10 acts as a guide for the rod 15, constraining it to a longitudinal linear motion.

The end 16 of the rod 15 is hinged, by a pin 17, to the first longitudinal end 18 of a fork 19, whose second longitudinal end 20 is hinged to the lever 7 by a pin 21 positioned near the above-mentioned pin 8. The pin 17 is slidably constrained to two guide and end of stroke slots 22, made in the sides of the second element 6 and extending in a prevalent direction of extension parallel with the direction B.

The position of the pin 21, which is closer to the axis B than the pin 8, and the pre-compression of the spring 13, guarantee an elastic action which tends to continuously push and hold the door 3 in its closed position.

Only when the closed position is almost reached, from and towards the closed position, overlapping with the above-mentioned elastic action of the spring 13 there is the action of another pre-compressed helical spring 23, designed to operate in conjunction with a cam 24 made on a second arm 9*b* of the rocker lever 7, through a rod 25 acting on a cam follower 26, to give the door 3 a spring-to closing movement and to define a door stable semi-open position. Specifically, the follower 26 is supported by a pin 27 slidably constrained to two guide and end of stroke slots 28, made in the sides of the second element 6 and extending in a prevalent direction of extension parallel with the direction B. The follower 26 is pushed towards the cam 24 by a race made on one end of the rod 25, and the latter is pushed by the spring 23 which is stopped in contact with a transversal separator 29 in the second element 6. The separator 29 is in an intermediate position between the separator 10 and the end 11 of the second element 6 and has an opening which acts as a guide for the rod 25, so as to constrain the rod to a longitudinal linear motion.

The spring 23 is smaller than the spring 13, since, while the function of the spring 13 is mainly to balance the weight of the door 3, the function of the spring 23 is, as indicated, to give the door 3 a spring-to closing movement and to define a door stable semi-open position.

The two springs 13 and 23, the relative rods 15 and 25, the fork 19 and the cam follower 26 as a whole form elastic means 30, inserted between the second element 6 and the lever 7 to apply on the lever 7 a two-step elastic action, specifically, during a first step, when the closed position is almost reached, from and towards the closed position, in which the action of the two springs 13 and 23 overlaps, and in a second step, between the above-mentioned door 3 stable semi-open position and the fully open position, in which the elastic action on the lever 7 is only applied by the spring 13.

Each of the two hinges 4 also comprises damping means 31, contained in the second element 6 and designed to apply a damping action on the lever 7 at the end of the closing stroke, that is to say, during the reciprocal motion of the first element 5 and the second element 6, when the door 3 closed position is almost reached.

The damping means 31 comprise a gas or fluid cylinder 32, having an outer body 33 mounted in the second element 6, near the longitudinal end 12 of the latter, and a rod 34 which can move with linear motion relative to the outer body 33.

The outer body 33 is housed in a fixed position in a support 35 which is constrained to the above-mentioned end 12 by a cylindrical hinge 36.

The rod 34 consists of a first portion 37 acting directly on the cylinder 32 piston and of a second portion 38 forming an extension, having a first longitudinal end 39 connected to the first portion 37 and a second longitudinal end 40 which is free, designed to act on the lever 7 during the reciprocal motion of the first element 5 and the second element 6 and when the closed position is almost reached.

Figure 2:
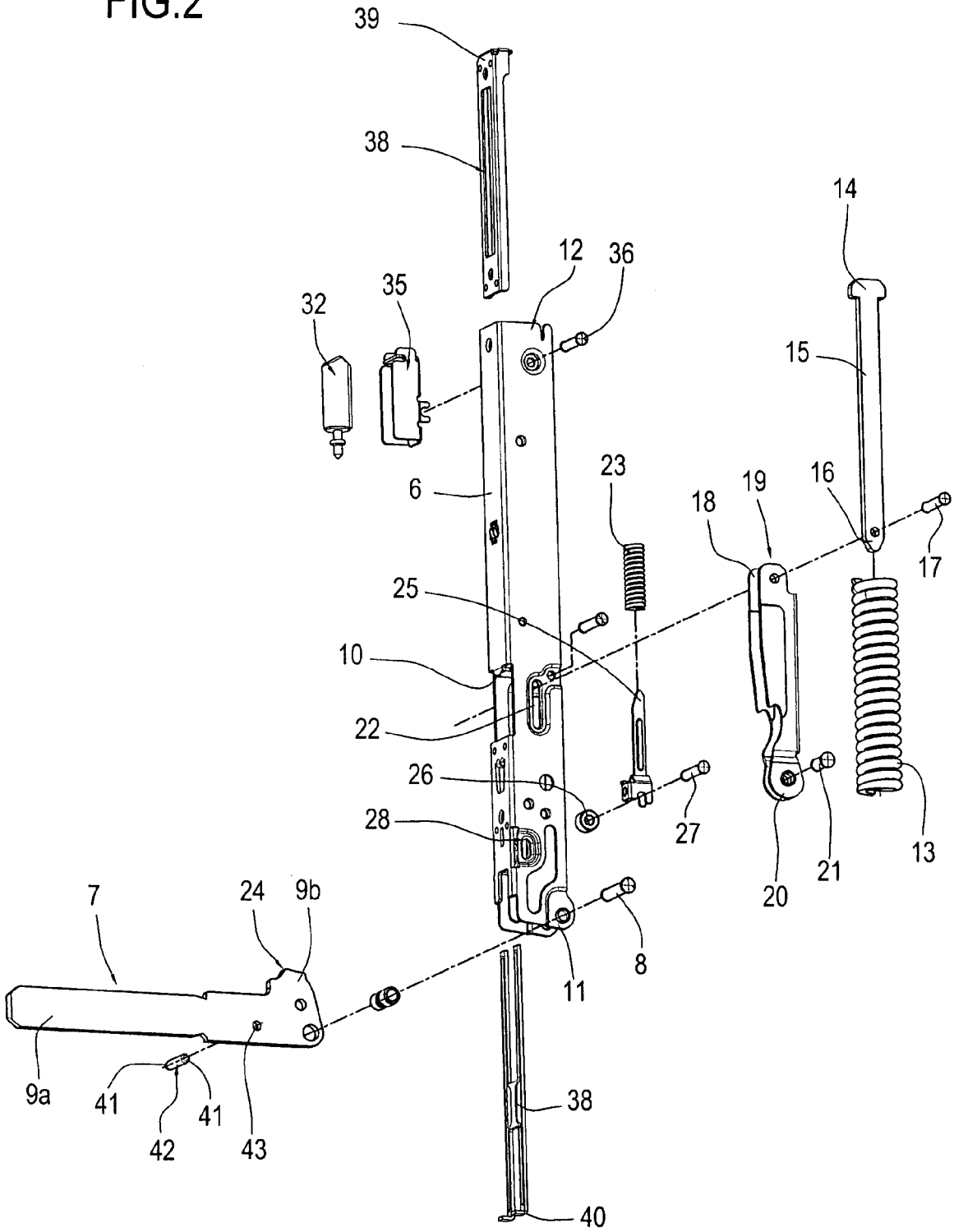
FIG. 2 is an exploded view of the hinge of FIG. 1*a;*

For this purpose, the lever 7 has two thrust projections 41, extending in such a way that they are aligned with one another longitudinally from two opposite faces of the lever 7, and the end 40 has a fork-shaped free end portion, designed to make contact with the projections 41, simultaneously, when the door 3 has almost reached its closed position, and to remain in contact until the closed position is reached. As illustrated in FIG. 2, the projections 41 are formed by the two longitudinal ends of a cylindrical element 42, inserted in a through-hole 43 in the lever 7 and rigidly constrained to the lever.

The following is a brief description of the operation of one of the two hinges 4 starting at the door 3 closed position, illustrated in FIGS. 1*a* and 1*b*.

The torque applied to the door 3 when it is opened by the user and, beyond a predetermined rotation, by the weight of the door 3, conflicts with the torque generated by the elastic means 30, which therefore render the movement of the door 3 towards the fully open position gradual and subject to a braking action. During the initial opening step, the action applied on the lever 7 by the damping means 31, which continues for as long as there is contact between the end 40 and the projections 41, is negligible compared with the torque applied by the user.

Figure 3A:
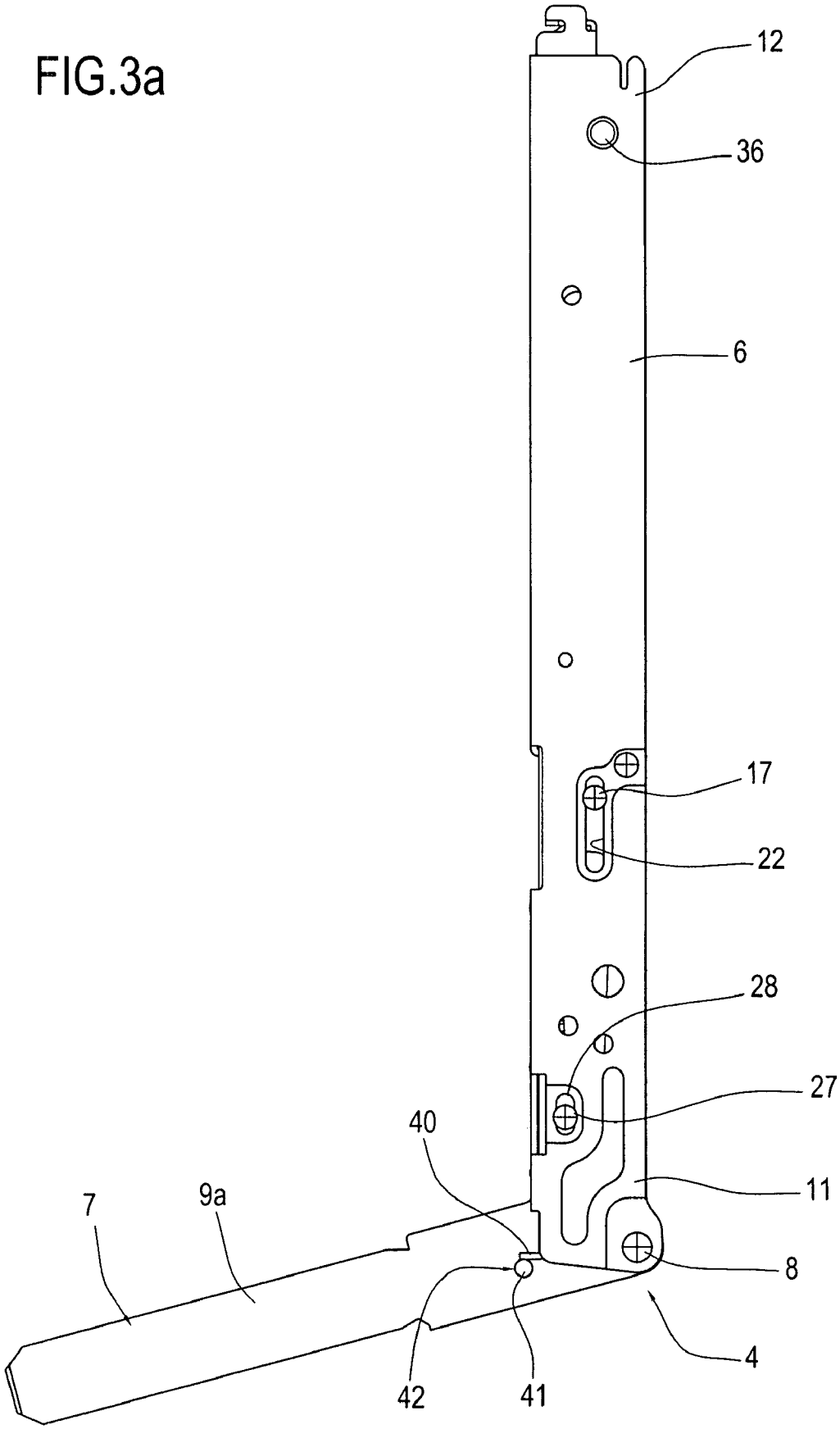
FIGS. 3*a*, 3*b* and 3*c* are respectively a front view, a longitudinal section and a perspective view with some parts cut away for clarity, of the hinge of FIG. 1*a* in an intermediate position.
Figure 3B:
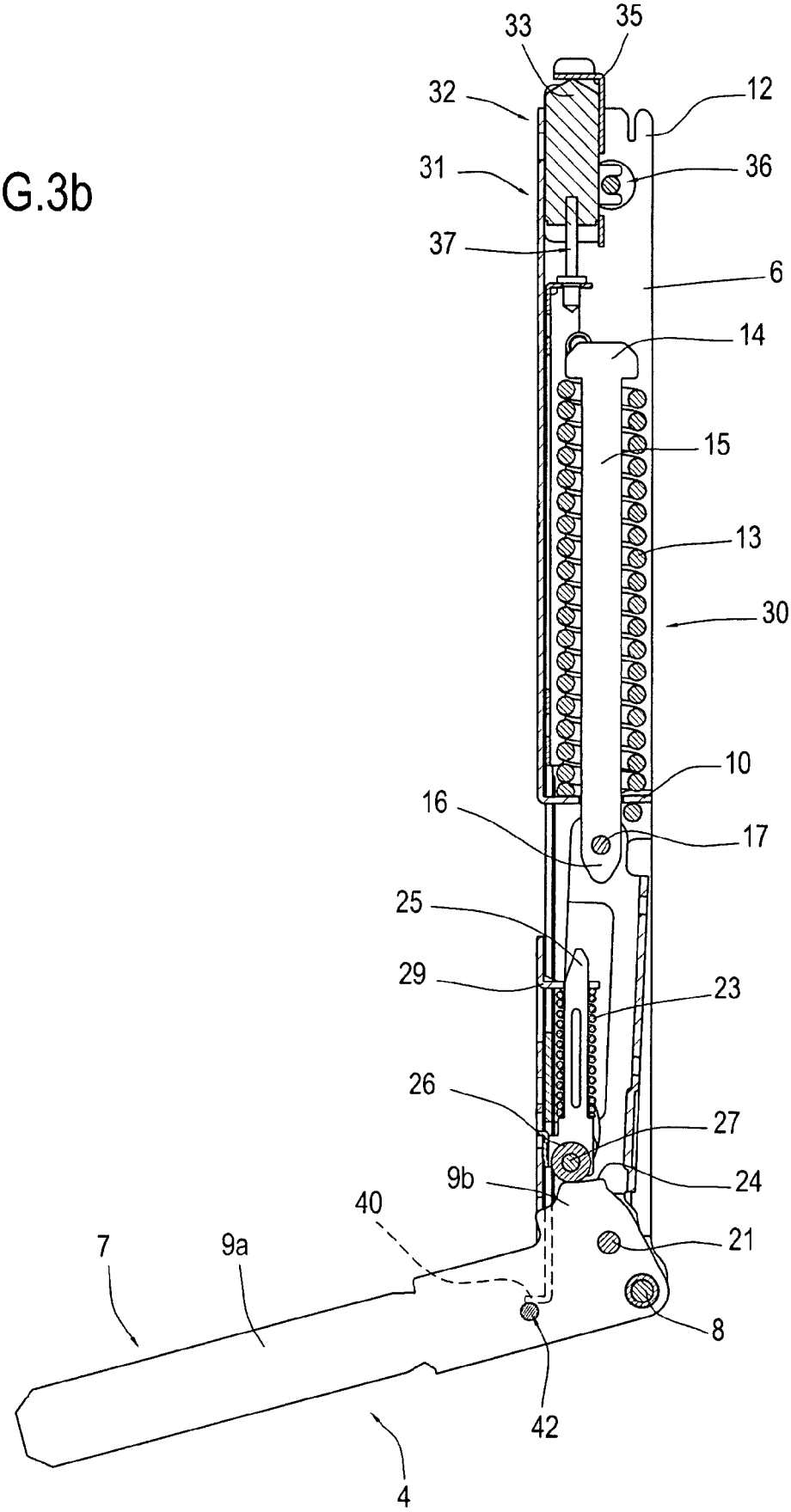
Figure 3C:
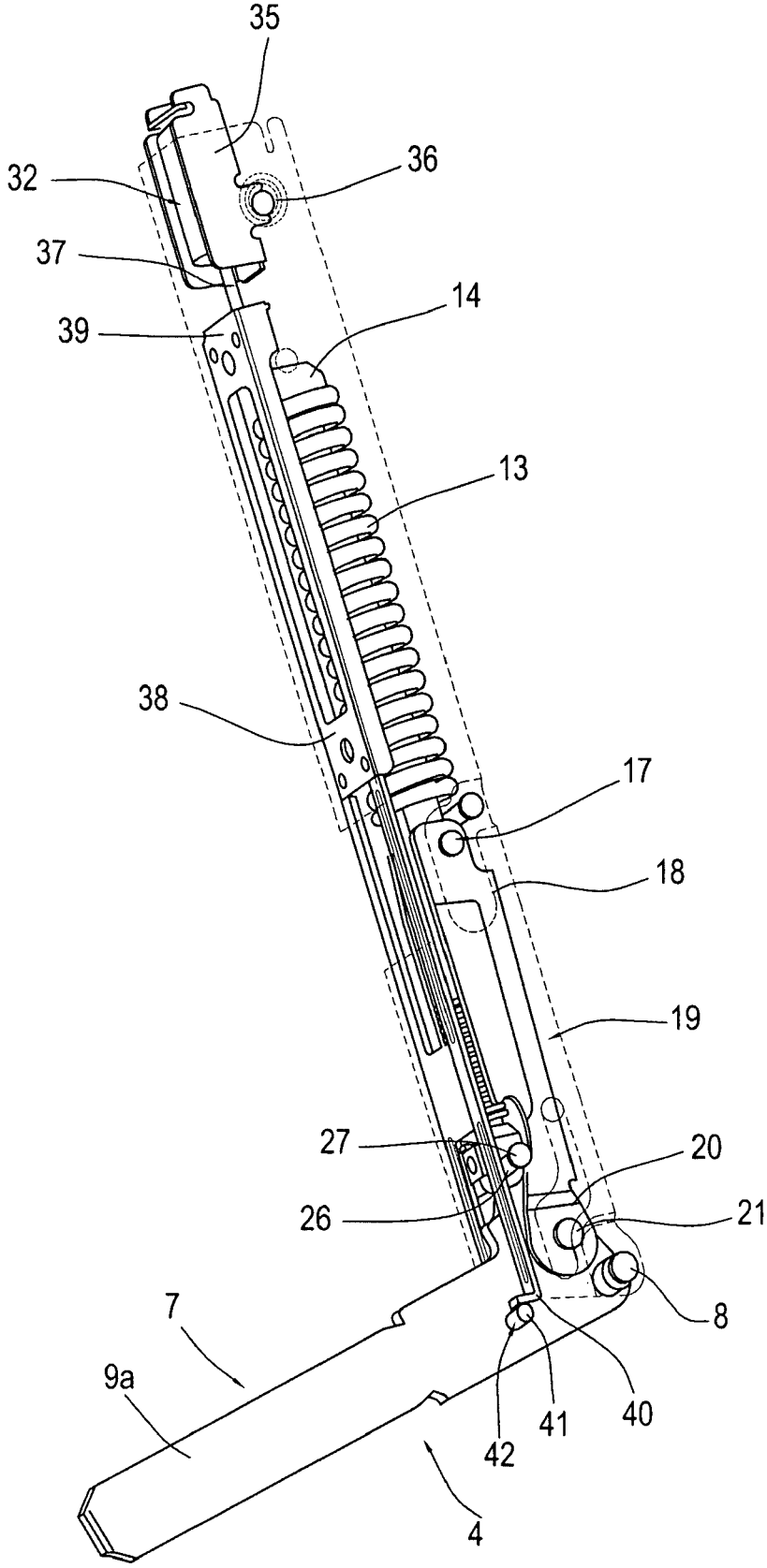

Starting from the door 3 fully open position, a rotation of the door towards the closed position is promoted by the action of the elastic means 30 and is initially hindered by the weight of the door 3. When the door 3 reaches an intermediate closing position, in which contact is made between the end 40 and the projections 41 (FIGS. 3*a*, 3*b* and 3*c*), following cylinder 32 compression, the damping means 31 apply a damping action conflicting with the closing action applied by the elastic means 30, and therefore render the door 3 movement towards the fully closed position gradual and subject to a braking action.

It is therefore evident that, even in the absence of a braking action by the user, the door 3, pushed towards the oven 1 frame 2 by the elastic means 30, reaches the frame in a gentle, silent way thanks to the end of stroke damping provided by the damping means 31.

It should also be emphasized that the damping means 31 are housed in the hinge 4, in a position hidden from view and protected from impacts or dirt, with obvious advantages in terms of appearance and reliable operation.

According to an alternative embodiment, not illustrated, the first element 5 is fixed to one edge of the door 3 and the second element 6 is fixed to the oven 1 frame 2 at one side of the mouth of the oven.

It is also evident that, in addition to the specific example of use described above, a hinge of the type disclosed may advantageously be used to constrain a generic wing to a respective frame.

What is claimed:

1. A hinge for wings or doors, in particular of electrical appliances, comprising:

a first element;

a second element; and a lever for connecting the first element and the second element, the lever pivoting on the second element by means of a pin and having a first portion integral with the first element to render the first element and the second element movable relative to one another with a tilting action, wherein the first element and the second element may be affixed, one to a frame and the other to a wing or door, so that the wing or door can move relative to the frame between a closed position and an open position;

the second element consisting of a substantially box-shaped body containing elastic means inserted between the second element and the lever for applying an elastic action on the lever; and wherein the hinge further comprises damping means contained in the second element for applying a damping action on the lever during the reciprocal motion of the first element and the second element, when the closed position is almost reached, the damping means comprising a gas or fluid cylinder, having an outer body mounted in the second element and a rod which can move with linear motion relative to the outer body and which is disengaged from the lever when the opened position is reached and which makes contact with thrust projections of the lever during the reciprocal motion of the first element and the second element, when the closed position is almost reached for contrasting the action of the elastic means.

2. The hinge according to claim 1, wherein the lever has at least one thrust projection positioned and shaped in such a way as to allow cylinder compression during the reciprocal motion of the first and second elements, when the closed position is almost reached.

3. The hinge according to claim 1, wherein the cylinder is positioned on the opposite side to the pin relative to the elastic means.

4. The hinge according to claim 3, wherein the rod consists of a first portion acting directly on the cylinder piston and of a second portion forming an extension, having a first longitudinal end connected to the first portion and a second longitudinal end which is free, being designed to make contact with the thrust projection during the reciprocal motion of the first element and the second element, when the closed position is almost reached.

5. The hinge according to claim 4, wherein the lever has two thrust projections extending in such a way that they are aligned with one another longitudinally from two opposite faces of the lever; the second end of the extension having a fork-shaped free end portion designed to make contact with the thrust projections simultaneously, during the reciprocal motion of the first element and the second element, when the closed position is almost reached.

6. A hinge for wings or doors, in particular of electrical appliances, comprising:

a first element;

a second element; and a lever for connecting the first element and the second element, the lever pivoting on the second element by means of a pin and having a first portion integral with the first element to render the first element and the second element movable relative to one another with a tilting action, wherein the first element and the second element may be affixed, one to a frame and the other to a wing or door, so that the wing or door can move relative to the frame between a closed position and an open position; the second element consisting of a substantially box-shaped body containing elastic means inserted between the second element and the lever for applying an elastic action on the lever;

wherein the hinge further comprises damping means mounted near the longitudinal end of the second element, opposed to the end hinged to the lever, for applying a damping action on the lever during the reciprocal motion of the first element and the second element, when the closed position is almost reached, the damping means comprising a gas or fluid cylinder mounted inside the second element; the lever having at least one thrust projection positioned and shaped in such a way as to allow cylinder compression during the reciprocal motion of the first element and the second element, when the closed position is almost reached;

the gas or fluid cylinder having a body mounted in the second element and a rod designed to make contact with the thrust projection during the reciprocal motion of the first element and the second element, when the closed position is almost reached;

the gas or fluid cylinder also being positioned on the opposite side to the pin relative to the elastic means; and the rod consisting of a first portion acting directly on the cylinder piston and of a second portion forming an extension, having a first longitudinal end connected to the first portion and a second longitudinal end which is free, being designed to make contact with the thrust projection during the reciprocal motion of the first element and the second element, when the closed position is almost reached.

* * * * *